United States Patent [19]

Roberts et al.

[11] Patent Number: 4,867,182

[45] Date of Patent: Sep. 19, 1989

[54] TEMPERATURE/HUMIDITY CONTROLLED VALVE FOR A SMOKING ARTICLE

[75] Inventors: Donald L. Roberts; David W. Boldridge, both of Winston-Salem, N.C.

[73] Assignee: R. J. Reynolds Tobacco Company, Winston-Salem, N.C.

[21] Appl. No.: 170,600

[22] Filed: Mar. 16, 1988

[51] Int. Cl.[4] ..... A24D 3/04

[52] U.S. Cl. ..... 131/339; 131/194; 131/215.1; 131/215.2; 131/215.3

[58] Field of Search ..... 131/339, 194, 215.1, 131/215.2, 215.3

[56] References Cited

U.S. PATENT DOCUMENTS

| | | | |
|---|---|---|---|
| 2,550,286 | 4/1951 | Morton | 131/194 |
| 2,954,786 | 10/1960 | Lebert | 131/339 |
| 3,292,635 | 12/1966 | Kolodny | 131/339 |
| 3,441,028 | 4/1969 | Wall | 131/338 |
| 3,800,805 | 4/1974 | Horsewell et al. | 131/338 |
| 3,916,914 | 11/1975 | Brooks et al. | 131/338 X |
| 4,119,105 | 10/1978 | Owens, Jr. | 131/338 |
| 4,474,192 | 10/1984 | MacLean et al. | 131/338 X |
| 4,615,344 | 10/1986 | Ringrose | 131/215.3 X |
| 4,638,820 | 1/1987 | Roberts et al. | 131/336 |
| 4,754,766 | 7/1988 | Luke et al. | 131/339 |

*Primary Examiner*—V. Millin
*Assistant Examiner*—Joe H. Cheng

[57] ABSTRACT

A smoking article having a valve system for closing off the flow of smoke to the user in response to an increase in temperature or humidity. The valve system includes a plastic body with a hollow valve chamber communicating with a smoke passage. A valve element is located in the chamber and is movable between a first position in which smoke from the smoking article is allowed to pass through the smoke passage and a second position in which the valve element closes the smoke passage thereby preventing smoke from passing therethrough. Expansion means are connected to the valve element and cause the valve to move between the first and second positions in response to the temperature or humidity of the smoke.

20 Claims, 3 Drawing Sheets

TEMPERATURE/HUMIDITY CONTROLLED VALVE FOR A SMOKING ARTICLE

FIELD OF THE INVENTION

The present invention relates generally to a smoking article and more particularly to a temperature or humidity responsive valve system disposed in a smoking article, such as a filtered or unfiltered cigarette, to reduce the tar delivery of the smoking article as it is being smoked. While the invention is described in connection with a cigarette, it will be understood that the invention is equally useful in other types of smoking articles, such as cigars, pipes and the like.

DESCRIPTION OF THE PRIOR ART

Heretofore, in the field of smoking articles, a number of devices have been developed to reduce the amount of tar and other particulate matter delivered to the smoker. In U.S. Pat. No. 3,916,914 to Brooks et al, for example, there is disclosed a cigarette having a filter comprising a pair of spaced apart filter sections surrounded by a sleeve formed of a monoaxial heat shrinkable material and disposed in a tipping paper tube. The sleeve shrinks in response to heat to control the relative positions of the filter sections and the intake of air through ports in the tipping paper tube. If the heat shrinkable material is biaxially shrinkable, the filter is also radially compressed which inherently reduces the size of the smoke passage and is said to have the effect of decreasing the delivery of total particulate matter.

U.S. Pat. No. 3,800,805 to Horsewell et al disclose the use of a band of heat shrinkable material to control flow by constricting the smoke flow path or by closing the gap around a smoke-impermeable body. As the heat of the burning cigarette causes the heat shrinkable material to shrink, the cigarette becomes increasingly difficult or incapable of being smoked.

U.S. Pat. No. 3,441,028 to Wall discloses a cigarette having a filter and an aerating means which includes a heat responsive bimetallic strip as a valve element to control air flow through air intake openings.

U.S. Pat. No. 3,292,635 to Kolodny discloses a cigarette holder having baffle discs which are manually extendable to increase the travel distance of the smoke.

An additional patent of interest is U.S. Pat. No. 4,638,820 which is assigned to the assignee of this invention and discloses a puff control cigarette in which smoke passing to the smoker is cut off at a preselected smoke flow rate and ventilation air is admitted to the cigarette.

SUMMARY OF THE INVENTION

It is a primary objective of the present invention to provide a system for use in a smoking article in which smoke passage restriction is accomplished by a movable valve means.

It is another object of this invention to provide a valve system for a smoking article which has a movable valve means responsive to the temperature of the smoke flowing through the smoke passage for closing off the smoke passage.

It is another object of this invention to provide a valve system for a smoking article which has a movable valve means responsive to the humidity of the smoke flowing through the smoke passage for closing off the smoke passage.

Briefly described, the aforementioned objects are accomplished according to the present invention by providing a valve system for use in a smoking article, such as a cigarette, said valve system including a body with a hollow chamber communicating with a smoke passage, a valve element adapted to mate with the smoke passage and movable between a first position in which smoke from the smoking article is allowed to pass through the smoke passage and a second position in which the valve closes the smoke passage thereby preventing smoke from passing through the smoke passage, and means responsive to the temperature or humidity of the smoke connected with the valve element whereby the valve element is moved from the first position to the second position. In the embodiments disclosed herein, an increase in temperature or humidity causes the valve to move toward the closed position, whereas a decrease in humidity causes the valve to move toward the open position.

In some embodiments of the invention, the valve is arranged to close by movement in the same direction as the flow generated by the draw on the cigarette so that the smoker's puff aids in the proper seating of the valve. In addition, that arrangement prevents the user from overriding the operation of the valve system by taking a strong draw on the cigarette.

With the foregoing and other objects, advantages and features of the invention that will become hereinafter apparent, the nature of the invention may be more clearly understood by reference to the following detailed description of the invention, the appended claims and to the several views illustrated in the attached drawings.

DESCRIPTION OF THE PREFERRED EMBODIMENTS

Figure 1:
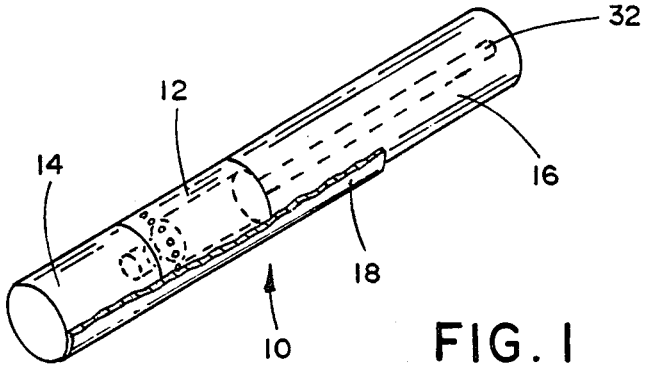
FIG. 1 is a perspective view of a filter cigarette, partially broken away showing a preferred arrangement of the valve system of the invention.

Referring now in detail to the drawings wherein like parts are designated by like reference numerals throughout, there is illustrated in FIG. 1 a filtered cigarette 10 incorporating a valve system 12 according to the invention and provided at the draw end of the valve system with a conventional filter 14. In an unfiltered cigarette, the valve system is preferably located in the position of the filter 14 at the draw end of the cigarette. A tobacco rod 16 wrapped in cigarette paper is positioned at the other end of the valve system and the rod 16, valve system 12 and filter 14 are fixed together in end-to-end relation by means of circumferentially wrapped tipping paper 18 shown partly broken away in FIG. 1.

The tobacco rod 16 preferably has a hollow or low density central core 32 for maximum effectiveness of the temperature responsive valve system. One example of a tobacco rod having a hollow or low density central core is disclosed in U.S. Pat. No. 4,632,130 to Heitmann et al. In a filtered cigarette with a tobacco rod having a uniform cross-sectional density of tobacco, there is a relatively small increase in temperature of the smoke over 100° F. at the interface between the tobacco rod and the filter until after about the fifth puff. With a hollow core cigarette, however, the smoke temperature reaches 130° F. or more in 2 or 3 puffs. The valve system of the present invention is designed to be activated when the temperature of the smoke reaches 120° F. to 130° F. Thus, the smoker obtains 2 or 3 puffs of higher flavor and impact smoke before the temperature responsive valve system begins to restrict, and eventually shut down, delivery of smoke from the tobacco rod. When the temperature responsive valve system of the invention is used in a conventional cigarette (filtered or unfiltered), i.e., a tobacco rod of substantially uniform cross-sectional density, the system functions to smooth out the tar delivery of the final puffs on the cigarette and provides better control of tar delivery.

Figure 2:
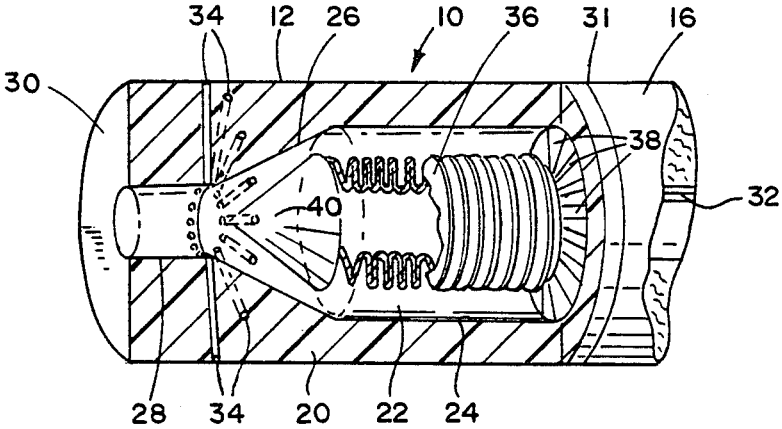
FIG. 2 is a partial perspective view illustrating a first embodiment of a valve system in accordance with the invention.

Referring now to the partial perspective view of FIG. 2, a first embodiment of the valve system 12 of the invention is shown positioned at the draw end of a hollow core tobacco rod 16 in a smoking article such as a cigarette. The valve system 12 comprises a cylindrical body 20 having a diameter approximately the diameter of tobacco rod 16. Body 20 is preferably molded of a plastic material and is provided with a hollow chamber 22 having a cylindrical portion 24 and a conical portion 26 which communicates with a tubular smoke passage 28 provided at the draw end 30 of the body 20 of the valve system. The opposite end 31 of the body 20 confronts the draw end of tobacco rod 16 with the axis of hollow chamber 22 coincident with the axis of the hollow core 32 in tobacco rod 16.

A plurality of radial air dilution holes 34 are provided in the body 20 in a plane transverse to the cigarette axis in registry with corresponding holes (not shown) in tipping paper 18. Holes 34 intersect smoke passage 28 adjacent the conical portion 26 of the hollow chamber 22. The number and size of the air dilution holes are selected to permit sufficient air to be drawn into the smoke passage so that when the valve system interrupts the flow of smoke, the user is still able to draw or puff on the cigarette even though the flow is substantially all air. Preferably, the air dilution holes 34 are provided after assembly of the cigarette, including wrapping of the tipping paper 18. However, it is also possible to form the holes 34 during the manufacture of plastic body 20 and form corresponding holes in the tipping paper 18 before or after assembly.

Located coaxially in hollow chamber 22 is an expansion means, such as a bellows 36, which is smaller in diameter than cylindrical portion 24 of the hollow chamber. Bellows 36 is connected slightly inwardly of the end 31 of the body 20, by means of a plurality of spaced radial fingers 38, or by any other suitable means which supports and permits flow past bellows 36, for example, a perforated plate. The expansion means in the FIG. 2 embodiment is in the form of the bellows 36 in which air or another gas is hermetically sealed. Upon heating of the bellows by the smoke passing therearound when the smoker draws on the cigarette during a puff, the air or gas inside the bellows expands and causes the bellows to elongate axially. The bellows is preferably formed of metal, such as a metal foil, or any other suitable impermeable material.

Attached to the free end of the bellows (i.e., the end of the bellows disposed toward the draw end of the cigarette) is a conical valve element 40. Valve element 40 may be formed as the metal end closure of the bellows 36 or it may be, for example, a plastic element attached to the end closure of the bellows. The latter construction is preferred to simplify the manufacture of the bellows.

The valve system 12 is depicted in FIG. 2 under ambient conditions, that is, in its position prior to lighting of the cigarette, with the valve element 40 disposed in the conical portion 26 of the hollow chamber, but spaced from the wall thereof so that the passage of smoke through the hollow chamber 24 and smoke passage 28 is substantially unobstructed. Those skilled in the art will appreciate that, after the cigarette has been lighted, and heated smoke and air are drawn through the core 32 to the smoke passage 28, the air or gas in the bellows will begin to heat up. The heated flow will expand the bellows axially (toward the left as seen in FIG. 2) until the valve element 40 seats at some point on the conical portion 26 thereby shutting off the flow of smoke to the smoke passage 28 and to the smoker and permitting flow of air to the smoke passage via air dilution holes 34. Advantageously, the conical valve element 40 is self-centering in the conical portion 26 of the hollow chamber 22 so that any sag or offset of the expansion means from the axis of the cigarette will not detrimentally affect the performance of the valve system.

As noted above, the valve system for a hollow or low density core tobacco rod may be designed to permit 2 to 3 puffs of high flavor and impact smoke before the heat responsive valve system begins to close off the smoke passage. By appropriate variations in the expansion means and valve element, the valve system can be designed to variably restrict or shut off completely smoke flow at a predetermined number of puffs.

In addition to the bellows configuration, the expansion means may be constructed in a variety of other configurations, such as fan-folded strips, corrugations, or spiraled expansion devices. Bimetallic elements may also be used to provide an appropriate expanding mechanism.

Figure 3:
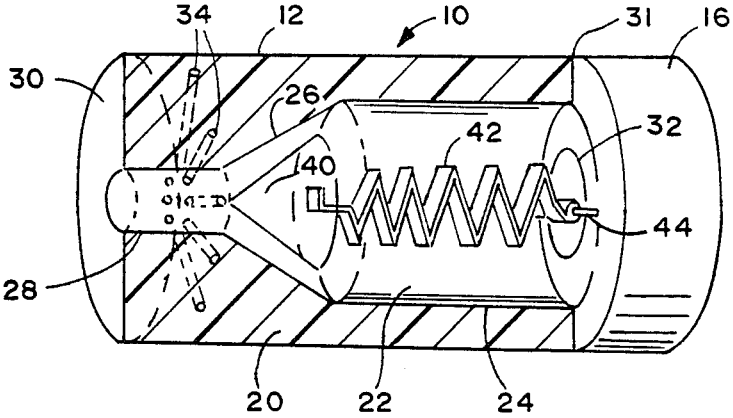
FIG. 3 is a partial perspective view illustrating a second embodiment of a valve system in accordance with the invention.

Referring now to a second embodiment of the invention illustrated in FIG. 3, the expansion means is in the form of a fan-folded strip 42 which elongates when heated. The strip 42 is mounted at the end 31 of the body 20 by means of a rod 44 which extends diametrically across the opening of the hollow chamber 22 confronting the tobacco rod 16. One end of the strip 42 is rigidly secured to rod 44 while the other end is fastened to the valve element 40. The fan-folded strip is preferably made of a metal with a high coefficient of expansion or a bimetallic strip. Operation of the valve system of FIG. 3 is similar to that of the valve system of FIG. 2 and is not described further herein.

Figure 4:
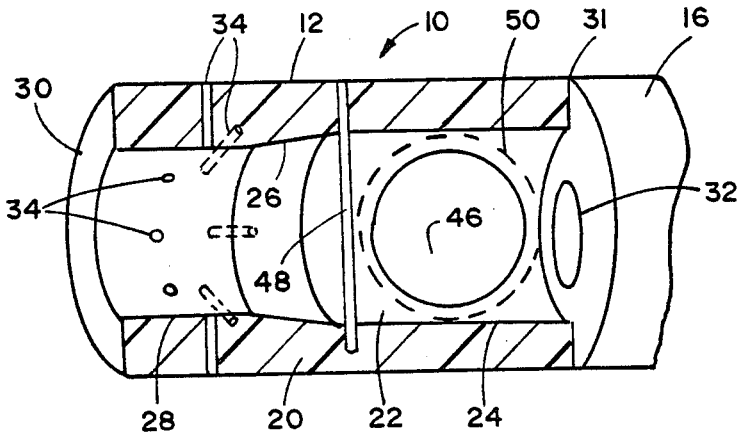
FIG. 4 is a partial perspective view of a third embodiment of a valve system in accordance with the invention.

FIG. 4 illustrates a further embodiment of the invention in which an expandable spherical element, such as a balloon 46, is disposed in the cylindrical portion 24 of the hollow chamber 22. A rod 48 extends diametrically across the chamber 22 to prevent the balloon from being drawn into the conical portion 26 and closing off the smoke passage solely as a result of the air flow induced by the smoker. Balloon 46 is filled with air, $CO_2$ or some other suitable gas which will expand when heated, thereby causing the balloon to expand into sealing engagement with the wall of the cylindrical portion 24 of the chamber as indicated by the dotted lines 50.

If desired, means may be provided for constraining the balloon 46 on both sides, i.e., axially constrained, so that expansion of the balloon is substantially radially directed toward the wall of the chamber 22. Such means may be, for example, a pair of perforated plates transversely disposed across the cylindrical portion 24 at a spacing equivalent to the diameter of the balloon under ambient conditions, i.e., when the cigarette is not lighted.

Figure 5:
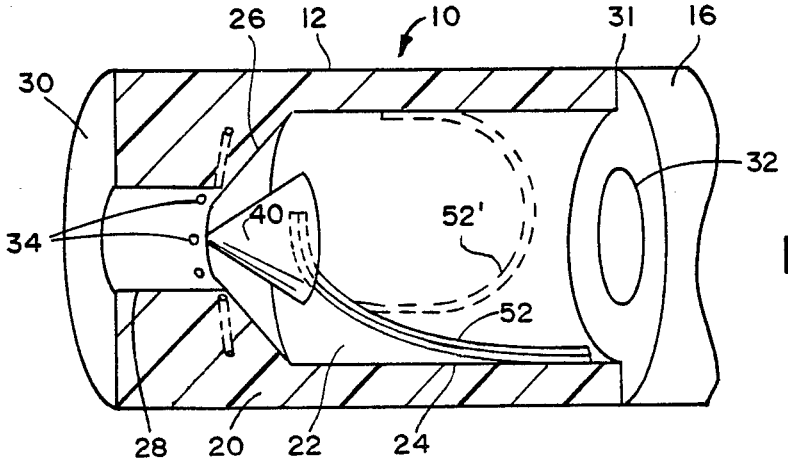
FIG. 5 is a partial perspective view of a fourth embodiment of a valve system in accordance with the invention.

Referring now to FIG. 5, a fourth embodiment of the invention is illustrated in which the expansion means comprises a bimetallic element 52, one end of which is fixed to the wall of chamber 22 and the other end of which is fixed to valve element 40. An alternative location and design of the bimetallic expansion means or strip is illustrated in phantom lines in FIG. 5 and is designated with reference numeral 52'. As is apparent from the showing of FIG. 5, when the bimetallic element 52 or 52' is heated by the smoke passing through chamber 22, it is caused to straighten, thereby moving the valve element 40 toward the left as seen in FIG. 5. Continued leftward movement of valve element 40 causes it to seat in the smoke passage 28 to shut off the flow of smoke through passage 28 and permit only air flow through the smoke passage 28 via air dilution holes 34. It should be apparent that bimetallic element 52' provides better contact with the hotter portion of the smoke flow through chamber 22 and a greater movement capability than bimetallic element 52.

Figure 6:
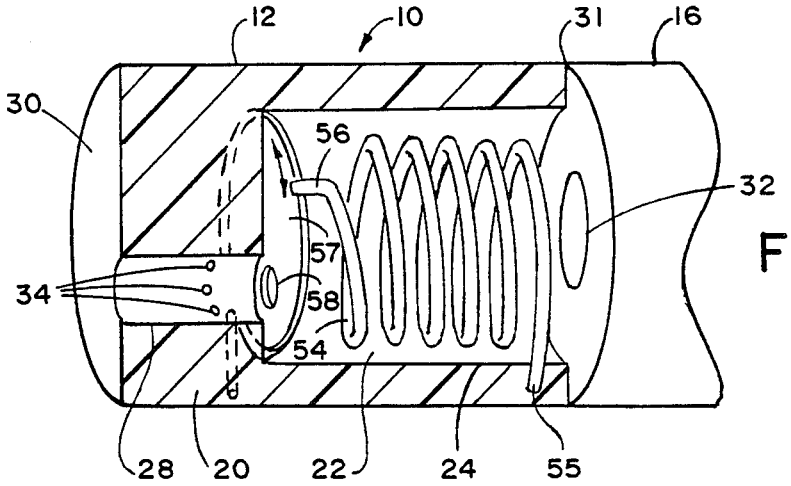
FIG. 6 is a partial perspective view of a fifth embodiment of a valve system in accordance with the invention.

A fifth embodiment of the invention is illustrated in FIG. 6 in which the hollow chamber 22 in body 20 comprises a cylindrical portion 24 which communicates at the draw end thereof with a smoke passage 28 offset radially from the central axis of body 20. A bimetallic coil 54 is coaxially arranged in chamber 22 and is supported by means of embodiment of an end 55 of the coil in body 20 adjacent the end 31 of the body. It will be apparent that other suitable means may be provided for mounting the coil 54 in the chamber 22.

The other end 56 of coil 54 is affixed to a plate or disk 57 having a diameter slightly less than the diameter of cylindrical portion 24. Disk 57 is provided with an aperture 58 radially offset from the center of the disk such that under ambient conditions of the valve system 12, i.e., when the cigarette 10 is unlit, the aperture 58 and smoke passage 28 are in alignment as shown in FIG. 6.

In operation, heated air and smoke is drawn through the hollow core 32 of the tobacco rod 16 into the hollow chamber 22 and out to the smoker through aperture 58 and smoke passage 28. As the bimetallic coil 54 is heated it begins to rotate (counterclockwise or clockwise depending on the design of the bimetallic coil) until the aperture 58 is no longer in alignment with the smoke passage 28. Instead, a solid, imperforate portion of the disk 57 blocks the flow of smoke into the smoke passage and thus to the smoker. Air is then drawn through air dilution holes 34 into the smoke passage 28.

Figure 7:
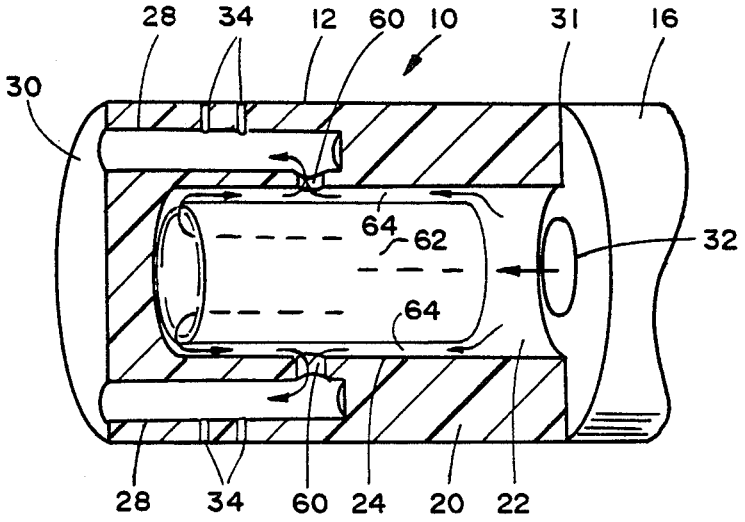
FIG. 7 is a partial perspective view of a sixth embodiment of a valve system in accordance with the invention.

FIG. 7 illustrates another embodiment of the invention in which the body 20 is provided with a coaxial, elongated hollow cylindrical chamber 22 and a pair of smoke passages 28 arranged in offset relation to chamber 22 along a common diameter and with their axes parallel to the axis of the chamber 22. Smoke passages 28 are provided with air dilution holes 34 and communicate with the main chamber 22 via ports 60. A thin-walled cylindrical sleeve 62 is disposed in chamber 22 and is made of a material having a higher coefficient of expansion than the material of the body 20.

Under ambient conditions with the cigarette 10 unlit there is a small annular space or gap 64 (shown exaggerated in FIG. 7) between the exterior wall of sleeve 62 and the wall of chamber 22. When the cigarette is lighted, the smoker draws heated smoke and air through the core 32 of tobacco rod into chamber 22 and out ports 60 into smoke passages 28 as shown by the arrows. As the heated air and smoke heats the sleeve 62 and causes it to expand, the annular gap 64 is gradually decreased until after a few puffs on the cigarette the sleeve 62 closes off ports 60 and dilution air is drawn into the smoke passages 28. Preferably, the gap 64 between the sleeve and chamber walls and the relative coefficients of expansion of the materials of the body and sleeve are selected such that the ports 60 are closed by the sleeve when the temperature of the smoke increases 20 to 30 degrees F.

Figure 8:
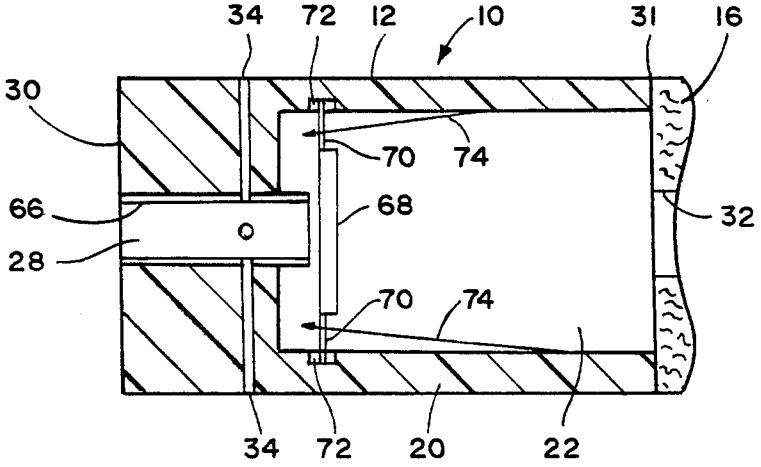
FIG. 8 is a partial cross-sectional view of a seventh embodiment of a valve system in accordance with the invention.

Another embodiment of the invention is shown in FIG. 8 in which the valve system 12 is responsive to the humidity of the heated smoke and air entering the cylindrical hollow chamber 22 in body 20. Smoke passage 28 comprises a tube 66 extending into the chamber 22 from the draw end 30 of the cigarette and is provided with a plurality of air dilution holes 34. A thin disk 68 is slidably supported in chamber 22 for axial back-and-forth movement by a plurality of pins 70 which travel in slots 72 in the wall of chamber 22. A plurality of humidity responsive fibers 74 which elongate in response to increased humidity are each connected at one end to a respective pin 70 (or to disk 68) and at the other end thereof to the wall of chamber 22 adjacent the end 31 of body 20. Fibers 74 may be human or animal hair, goldbeater's skin or any other suitable fiber which elongates in response to an increase in humidity.

The valve system in FIG. 8 is shown in the condition with the cigarette 10 unlit. When the tobacco rod 16 is lighted and the smoker draws on the cigarette, the suction force urges the disk 68 toward the left to the fully extended position of the fibers 74. Initially, there is a gap between the inner end of tube 66 and the surface of the disk 68. However, the smoke in the chamber 22 causes an increase in the humidity therein because of the inherent moisture content of the tobacco in the tobacco rod. The increased humidity causes elongation of the fibers 74 until the disk 68 engages the end of tube 66 and closes off flow through smoke passage 28.

Pins 70 may also be formed as straps fixed to the body 20 and permanently flexed in the direction of the tube 66. The fibers 74 are dimensioned to restrain flexing of the disk 68 toward the tube 66 until the increase in humidity causes elongation of the fibers, whereupon the disk is flexed toward the tube by the straps and eventually closes off flow therethrough.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A smoking article comprising, a smoke producing material, means providing a smoke passage in said smoking article for the smoke produced by said smoke producing material, valve means operatively associated with said smoke passage means for closing said smoke passage in response to the temperature of the smoke flowing therethrough, said valve means comprising a body having a hollow chamber with an axis and communicating with said smoke passage, a valve disposed in said chamber and being movable between a first position in which smoke is permitted to pass through said smoke passage and a second position in which the smoke is prevented from passing through said smoke passage, and expansion means in said chamber responsive to the temperature of the smoke for moving said valve element between said first and second positions.

2. A smoking article according to claim 1 wherein said expansion means comprises one of the group of a bellows, a fan-folded strip, a bimetallic strip, a fluid-filled balloon, a cylindrical sleeve and a bimetallic coil.

3. A smoking article according to claim 1 wherein said valve comprises one of the group of a conical valve element, a fluid-filled balloon, a disk, and a cylindrical sleeve.

4. A smoking article according to claim 1 including air dilution means connected to said smoke passage for admitting air to said smoke passage.

5. A smoking article according to claim 1 wherein said smoke producing material comprises a tobacco rod.

6. A smoking article according to claim 5 wherein said tobacco rod is one of the group of a hollow core tobacco rod, a low density core tobacco rod or a uniform density tobacco rod.

7. A smoking article according to claim 1 wherein said valve is a conical element and said expansion means is a hermetically sealed bellows, the apex of said conical element being directed toward said smoke passage.

8. A smoking article according to claim 1 wherein said valve is a conical element and said expansion means is a fan-folded strip, the apex of said conical element being directed toward said smoke passage.

9. A smoking article according to claim 1 wherein said valve is a conical element and said expansion means is a bimetallic strip, the apex of said conical element being directed toward said smoke passage.

10. A smoking article according to claim 1 wherein said valve and said expansion means comprises a balloon filled with an expansible fluid whereby upon heating the fluid by the smoke, the balloon expands radially into sealing relationship with the chamber walls.

11. A smoking article according to claim 10 including means for constraining expansion of the balloon along the longitudinal axis of the chamber.

12. A smoking article according to claim 1 wherein said valve is a disk having an opening therein, said expansion means comprising a bimetallic coil means for rotating said disk in said chamber between said first position in which said opening is aligned with said smoke passage and said second position in which said opening is misaligned with said smoke passage.

13. A smoking article according to claim 1 wherein said valve means further comprises a cylindrical sleeve arranged in said chamber, and at least two passage portions each communicating with said chamber via a respective port, said sleeve being expansible from a first position spaced from said ports to a second position closing at least one of said ports.

14. A smoking article according to claim 13 wherein said at least two passage portions is a plurality of passage portions and said chamber is a cylindrical chamber, at least two passage portions being arranged in the valve means offset from and parallel to the axis of the chamber, said port in each passage portion connecting each passage portion with the chamber, and said valve means further including air dilution holes communicating said offset passage portions with the exterior of said smoking article for admitting air to said offset passage portions when said ports in said offset passage portions are closed.

15. A smoking article according to claim 1 wherein said body comprises a cylindrical element made of a plastic material, said hollow chamber and smoke passage extending coaxially through said body, said hollow chamber comprising a cylindrical portion and a conical portion.

16. A smoking article comprising, a smoke producing material, means providing a smoke passage in said smoking article for the smoke produced by said smoke producing material, and valve means operatively associated with said smoke passage means for closing and opening said smoke passage in response to the humidity of the smoke flowing therethrough.

17. A smoking article according to claim 16 wherein said valve means comprises a body having a hollow chamber with an axis and communicating with said smoke passage, a valve disposed in said chamber and being movable between a first position in which smoke is permitted to pass through said smoke passage and a second position in which said smoke is prevented from passing through said smoke passage, and expansion means in said chamber responsive to the humidity of the smoke for moving said valve element between said first and second positions.

18. A smoking article according to claim 17 wherein said expansion means comprises a fiber which elongates in response to an increase in humidity.

19. A smoking article according to claim 18 wherein said fiber comprises one of the group of a human hair, an animal hair, and goldbeater's skin.

20. A smoking article comprising a smoke producing material, means providing a smoke passage in said smoking article for the smoke produced by said smoke producing material, a valve body disposed in said smoking article having a chamber communicating with said smoke passage, a valve element movable in said chamber between a first position in which smoke is permitted to flow through said smoke passage and a second position in which said valve element closes off said smoke passage to the flow of smoke, and means connected to said valve element for moving said valve element from said first position toward said second position in response to an increase in humidity of the smoke and for moving said valve element from said second position toward said first position in response to a decrease in humidity of the smoke.

* * * * *